United States Patent [19]

Fernandez

[11] 4,249,638

[45] Feb. 10, 1981

[54] LADDER EXTENSION APPARATUS

[76] Inventor: Albert Fernandez, 2208 W. Virginia Ave., Clarksburg, W. Va. 26301

[21] Appl. No.: 107,264

[22] Filed: Dec. 26, 1979

[51] Int. Cl.[3] ..... E06C 7/44

[52] U.S. Cl. ..... 182/201; 182/204

[58] Field of Search ..... 182/201-204; 248/188.6, 188.8, 188.1

[56] References Cited

U.S. PATENT DOCUMENTS

| | | | |
|---|---|---|---|
| 2,567,989 | 9/1951 | Cheek | 182/201 |
| 3,027,968 | 4/1962 | Ouellette | 182/201 |
| 3,089,563 | 5/1963 | Trumpolt | 182/201 |
| 3,937,298 | 2/1976 | Hurwitz | 182/204 |
| 4,085,820 | 4/1978 | Cerny | 182/204 |

*Primary Examiner*—Reinaldo P. Machado

*Attorney, Agent, or Firm*—Buell, Blenko, Ziesenheim & Beck

[57] ABSTRACT

A ladder extension device for enabling a ladder to stand upright upon uneven or inclined surfaces is disclosed which is composed of a pair of overlapping L-shaped side members secured about a ladder leg by bolts or other means.

4 Claims, 4 Drawing Figures

LADDER EXTENSION APPARATUS

This invention relates to ladder accessories for enabling a ladder to stand upright upon an uneven or inclined surface.

This invention is an improvement over my ladder extension apparatus disclosed in U.S. Pat. No. 4,143,742. That patent discloses a ladder extension apparatus comprising two L-shaped members connected by adjustable hinges to form a U-shaped channel. The apparatus is suitale for use on ladders of varying sizes and shapes. The problem with this apparatus is that the cost of the hinges is equal to or greater than the total cost of the unit's other components. Thus, if the hinges can be eliminated the cost of the apparatus can be substantially reduced. Furthermore, provision is made to receive a self leveling shoe.

I propose to provide an improved ladder extension apparatus adaptable for use on ladders of varying sizes and shapes which is relatively inexpensive to manufacture.

I propose to provide two L-shaped side members disposed so that one side of one L-shaped member will overlap one side of the other L-shaped member. A plurality of holes and slots are provided in the overlapping sides through which bolts pass to hold the L-shaped members in the desired position. This arrangement will provide an adjustable U-shaped channel that can be fitted over a variety of ladder legs. However, no hinges are needed for the device.

Other details, objects and advantages of the invention will become apparent as the following description of certain preferred embodiments thereof proceeds.

In the accompanying drawings, I have shown certain preferred embodiments wherein.

Figure 1:
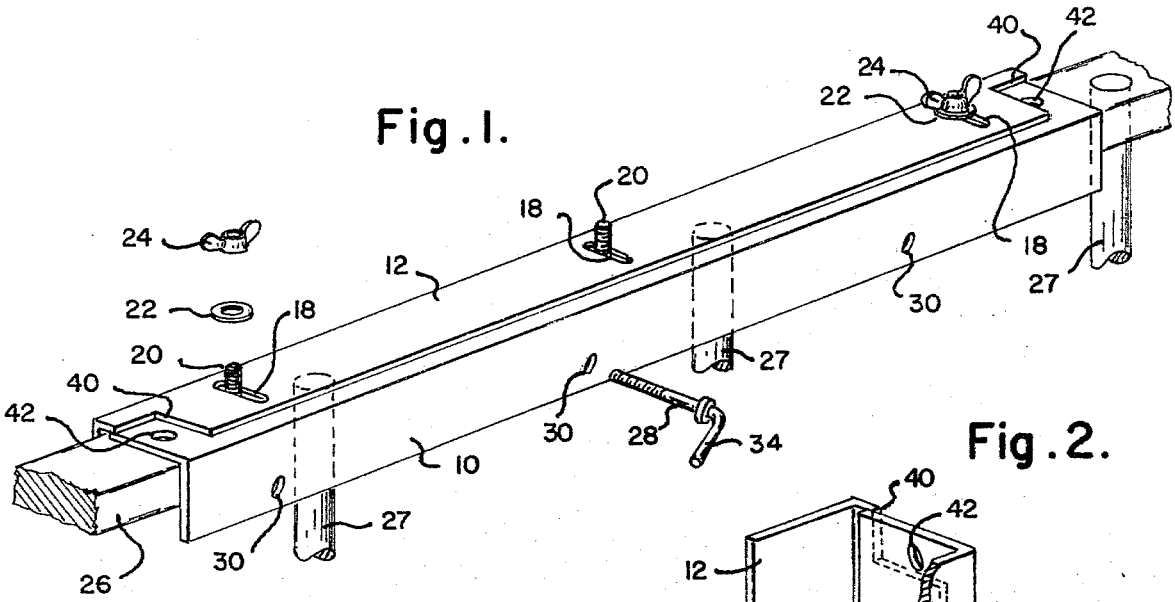
FIGS. 1 and 2 are isometric views of a present preferred embodiment of the apparatus employing L-shaped side members.
Figure 2:
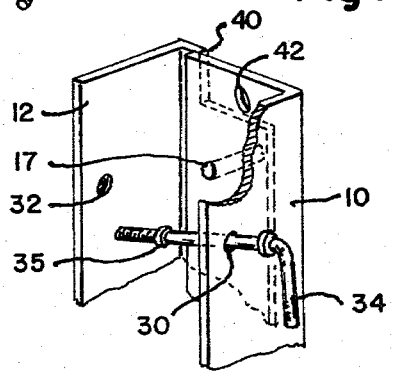

Referring to FIGS. 1 and 2 of the drawings, the present preferred embodiment of the ladder extension apparatus there shown comprises two overlapping L-shaped side members 10 and 12 disposed to form a U-shaped one channel. A plurality of holes 17 are provided in one of the overlapping sides and an equal number of elongated holes 18 are provided in the other overlapping side. A bolt 20 passes through each hole 17 and elongated hole 18 and is secured by a lock washer 22 and wing nut 24. The elongated holes 18 permit the side members 10 and 12 to be positioned at varying distances from each other. This enables the width of the U-shaped channel to be varied so as to accommodate ladder legs of a variety of sizes.

Figure 3:
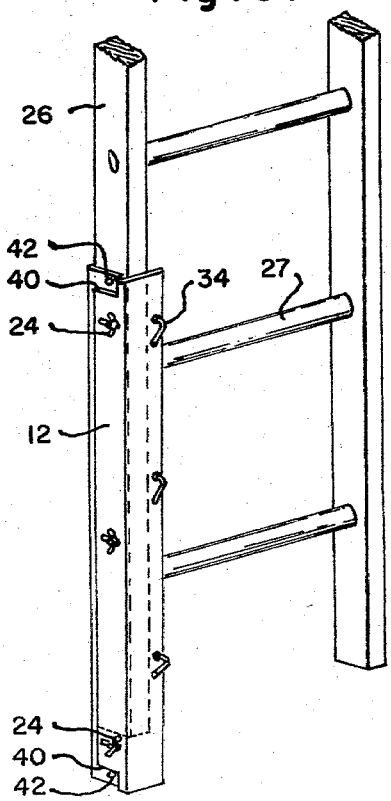
FIG. 3 is an isometric view showing the embodiment of FIGS. 1 and 2 attached to a ladder.

After the apparatus has been positioned about one leg of a ladder 26, as shown in FIG. 3, it is held in place by bolts 28 passing through oversized holes 30 in one L-shaped side member 10. The oversized holes 30 will permit the bolts 28 to hang loosely from the side member 10 when they are not or cannot be connected to the opposite side member 12. Consequently, unconnected bolts will not obstruct ladder rungs 27. When connected, the bolts 28 engage threaded holes 32 in the opposite side member 12. A keeper 35 is provided on each bolt 28 to prevent the bolt from slipping through the hole 30 and getting lost. A handle 34 is provided for each bolt 28 for ease of assembly. I prefer to provide at least three pairs of bolt holes 30 and 32 as shown in FIG. 2 so that in the event that one bolt is obstructed by a ladder rung, two bolts will remain to permit the apparatus to be secured to the ladder.

I further prefer to maintain equal spacing between adjacent pairs of holes and to locate the set of hole pairs off-center. Consequently, the distance between the left end of the side member and the left hole pair will be shorter or longer than the distance between the right end of the side member and the right hole pair. Such an arrangement will enable the device to provide a shorter or longer extension depending upon the orientation of the device with respect to the ladder.

Resilient pads (not shown) can be placed on the inner face of the side members to provide a tighter fit of the apparatus about the ladder leg.

Because the apparatus wraps itself about the ladder leg and is not bolted to the leg, it can be positioned so as to provide an infinite variety of extensions to the ladder leg. Hence, the extension is appropriate for any uneven surface.

Figure 4:
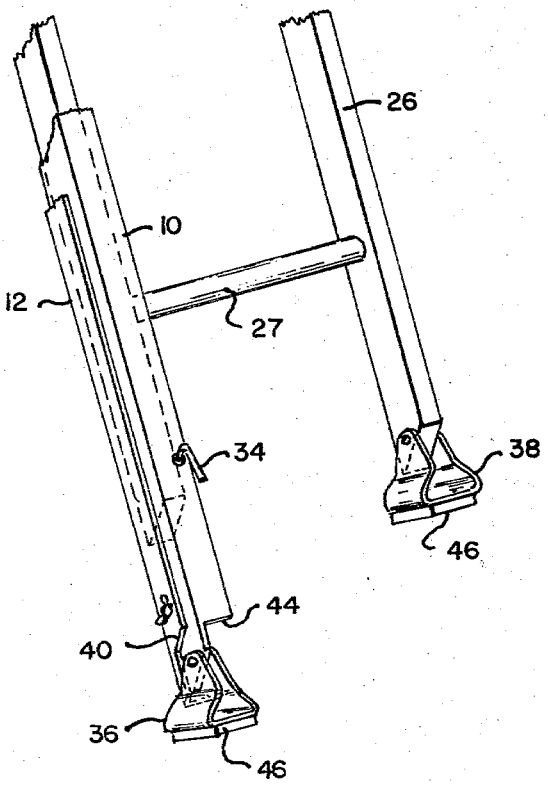
FIG. 4 is a perspective fragmentary view of a portion of the ladder extension showing a self leveling shoe and attached to a ladder which is straddled between a high and low surface support.

Referring to FIG. 4 self leveling shoes 36 and 38 are provided. A self leveling shoe 36 may be removed from the base of the ladder 26 and bolted on the end of L-shaped side member 10 as shown. To enable the L-shaped members 10 and 12 to be adjustable with respect to each other when the shoe 36 is attached, L-shaped member 12 has an L-shaped notch 40 at the end. This enables L-shaped member 12 to slide with respect to L-shaped member 10. To receive a bolt to attach the shoe 36 L-shaped member 10 has a hole 42 at the end. Each end of the L-shaped members 12 and 10 have the notches 40 and holes 42 respectively. To enable the shoe 36 to pivot upwardly to enable a spike on the shoe 36 (not shown) to be inserted in a soft surface an L-shaped notch 44 may be provided at each end of L-shaped member 10. The shoe 36 has an anti-skid pad 46 to prevent slip of the shoe 36.

While I have shown and described certain present preferred embodiments of the invention, it is to be distinctly understood that the invention is not limited thereto but may be otherwise variously embodied within the scope of the following claims.

I claim:

1. A ladder rail extension device comprising:
   a. at least three bolts;
   b. a pair of L-shaped side members disposed so that one side of one L-shaped side member overlaps one side of the other L-shaped member thereby forming a U-channel, one L-shaped member has at least three threaded holes sized to receive the bolts and the other L-shaped member has an equal number of larger holes, sized so as to permit a bolt to hang loosely from the side member when not engaged in a threaded hole;
   c. a keeper attached to each bolt to prevent the bolt from slipping out of the oversized hole; and
   d. a retaining means for holding the overlapping sides in desired position.

2. The ladder rail extension device in claim 1 wherein the overlapping side of one L-shaped member has a plurality of holes sized to receive a bolt, the other L-shaped member has an equal number of slots located and sized to receive bolts passing through the first L-shaped member and also comprising a plurality of bolts and nuts, the bolts passing through the holes and slots in the overlapping sides of the L-shaped members and held in place by the nuts.

3. The ladder rail extension device in claims 1 or 2 having a resilient pad attached to an inside face of each side member which grips the ladder rail.

4. The ladder rail extension device in claims 1 or 2 including an L-shaped notch at an end of one L-shaped side member and a hole in the other corresponding L-shaped side member near an end.

* * * * *

UNITED STATES PATENT AND TRADEMARK OFFICE

CERTIFICATE OF CORRECTION

PATENT NO. : 4,249,638

DATED : February 10, 1981

INVENTOR(S) : Albert Fernandez

It is certified that error appears in the above-identified patent and that said Letters Patent are hereby corrected as shown below:

Column 2, line 19, "face" should be --faces--.

Claim 1, column 2, line 63, --the-- should be inserted after "in".

Signed and Sealed this

*Fifth* Day of *May 1981*

[SEAL]

*Attest:*

RENE D. TEGTMEYER

*Attesting Officer* *Acting Commissioner of Patents and Trademarks*